United States Patent [19]

Phillips, II

[11] 4,031,583

[45] June 28, 1977

[54] INFLATABLE EMERGENCY EQUIPMENT DEPLOYMENT DEVICE

[75] Inventor: Ronald Wayne Phillips, II, Akron, Ohio

[73] Assignee: The B. F. Goodrich Company, Akron, Ohio

[22] Filed: Dec. 22, 1975

[21] Appl. No.: 643,344

[52] U.S. Cl. ..... 9/14; 182/48; 182/70; 193/25 B; 244/DIG. 2

[51] Int. Cl.[2] ..... B63C 9/22

[58] Field of Search ..... 9/11 A, 14, 30, 31, 9/41, 42; 244/DIG. 2; 182/70, 76, 48, 49, 53; 193/25 B

[56] References Cited

UNITED STATES PATENTS

| | | | |
|---|---|---|---|
| 335,372 | 2/1886 | Marcus et al. | 182/70 |
| 1,753,798 | 4/1930 | Martin | 182/70 |
| 3,754,291 | 8/1973 | Harris et al. | 9/14 |
| 3,809,181 | 5/1974 | Staranick | 182/70 |
| 3,910,532 | 10/1975 | Fischer | 244/DIG. 2 |

FOREIGN PATENTS OR APPLICATIONS

| | | | |
|---|---|---|---|
| 686,130 | 5/1964 | Canada | 182/70 |
| 1,149,706 | 12/1957 | France | 9/14 |

*Primary Examiner*—Trygve M. Blix
*Assistant Examiner*—Charles E. Frankfort
*Attorney, Agent, or Firm*—Harry F. Pepper, Jr.; W. A. Shira, Jr.

[57] ABSTRACT

An emergency evacuation device adapted for mounting on the edge of the deck of a ship or platform has a panel formed of two hinged sections which upon release rotate over the edge of the deck forming a protective apron. Devices are operatively associated with release of the panel to activate a system for inflating an emergency evacuation device such as a slide or slide/raft stowed in the container. The slide or slide/raft may be situated on an adjustable slope sheet which assists the slide or slide/raft in being properly and effectively deployed.

4 Claims, 5 Drawing Figures

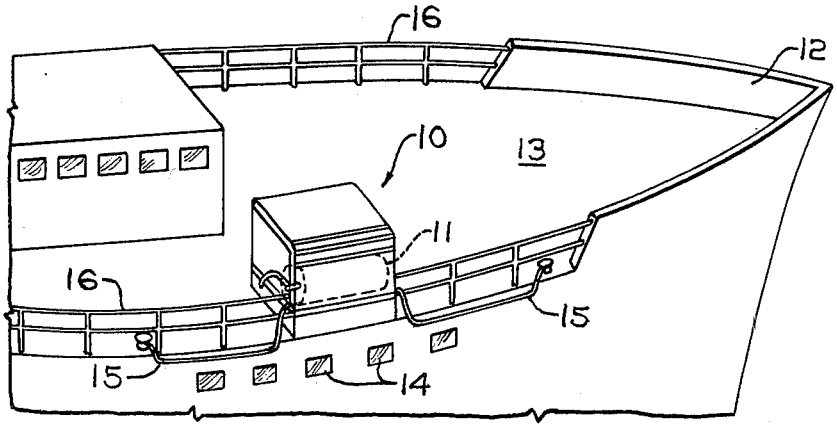
FIG. 1
FIG. 5
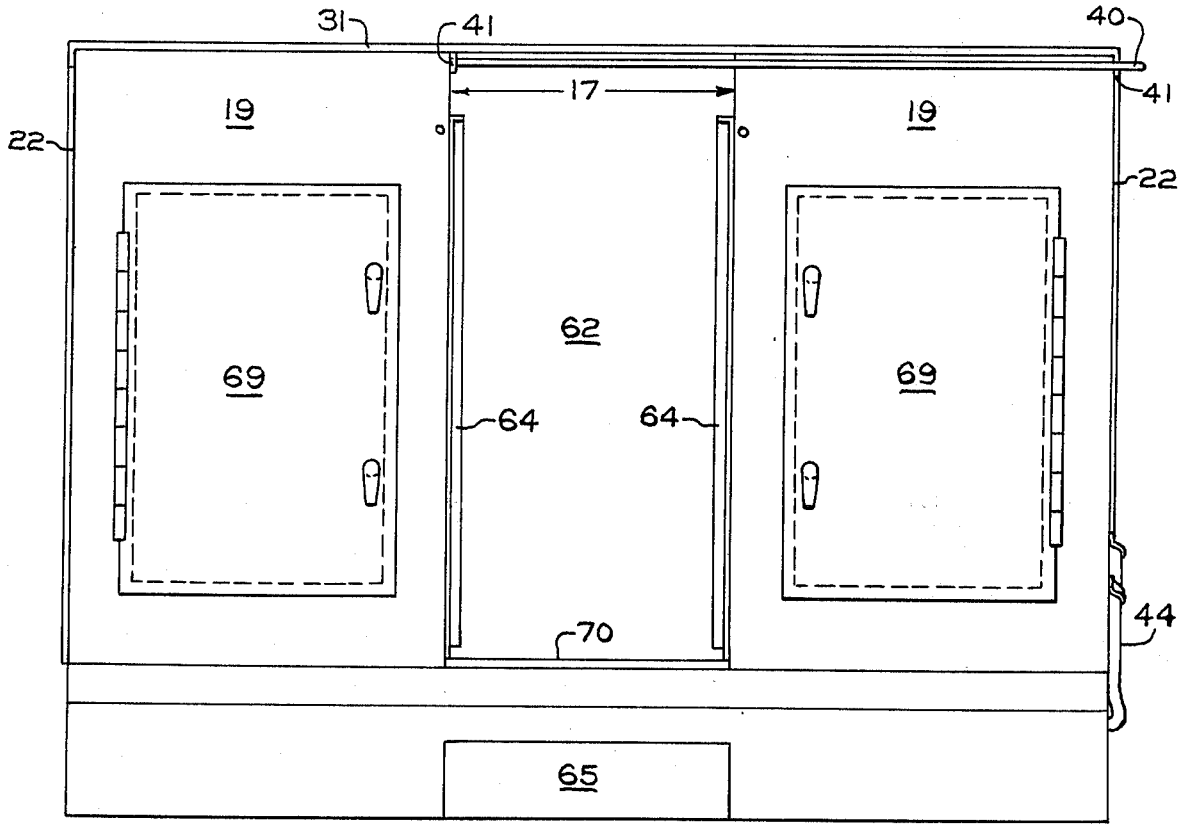

INFLATABLE EMERGENCY EQUIPMENT DEPLOYMENT DEVICE

BACKGROUND OF THE INVENTION

This invention relates to emergency evacuation inflatables and particularly to stowage and deployment devices used in conjunction with such inflatables.

In the case of fires or other emergencies at sea on a ship or a platform, such as a drilling platform, it is desirable to evacuate workers, passengers, crew members, and/or cargo as quickly and efficiently as possible. Emergency evacuation inflatables such as slides or slide and raft combinations ("slide/rafts") have been provided on ships and platforms for this purpose. These inflatables are usually stowed in a deflated condition. In an emergency they can be deployed from the ship or platform and inflated ready for use.

Presently, there are certain disadvantages in some of these emergency evacuation inflatable deployment and stowage systems. Some systems contain several components which are mounted in different locations on the deck of a ship or platform. These components may be scattered about over a large area and may be in the way of other functions on the deck. It should be noted that many slide or slide/raft deployments are for testing or training purposes and therefore repacking and recharging may be required often. Some systems can be difficult to recharge after deployment because repacking and recharging may have to be done on the ship or platform.

Slides and slide/rafts are usually stored on the deck of a ship or platform in some type of container which may also be adapted to assist in deploying the slide or slide/raft in an emergency. Some systems are not designed to be mounted near an edge of the ship or platform without the use of auxiliary devices such as aprons of the like.

Often, stowage and deployment devices do not have adequate temporary access openings. Thus, any inspection or repair must be doneafter a complete deployment of the slide or raft or after substantial disassembling and/or disengaging of the container. Many containers are not adapted to be easily disengaged.

A particular problem has been detected in some passenger ships because of a row or rows of portholes sealed by glass, or other below-deck openings directly below the edge of the deck. In the case of a fire or explosion, glass may be broken, thereby exposing a nearly deployed slide or slide/raft to direct fire or extreme heat. Furthermore, these portholes or other below-deck openings may have sharp edges or other protrusions which could puncture or otherwise damage or deflate an inflated slide or slide/raft. It has been suggested that an apron be permanently mounted on such ships directly below a slide or slide/raft deployment area to act as a fire or heat shield. However, someship manufactures and owners are reluctant to eliminate or permanently shield the portholes or other openings.

Panic may often occur on platforms or passenger ships during fires or other emergencies. The panic may increase during passenger evacuation operations because many evacuation systems contain no suitable passenger entry and guidance device such as a railing. This can cause a psychological strain along with safety problems such as falling off the deck.

Evacuation slides or slide/raft are not adequately protected from environmental conditions by some stowage devices therby creating a potential cause for deployment failure due to accelerated aging, corrosion, etc.

There are several different sizes and lengths of slides of slide/rafts which may be used depending upon the particular application. In some slide or slide/raft deployment devices, the volume of the container is not adjustable to the size of the slide or raft being used. Difficulty in deployment may result if the inflation apparatus can first expand and fill the container before it can be ejected.

SUMMARY OF THE INVENTION

It is an object of this invention to provide an improved combination stowage and deployment device for emergency escape inflatables.

It is another object of this invention to provide an emergency escape inflatable stowage and deployment device which can be used in conjunction with an inflation system to form a neat, compact package.

It is a further object of this invention to provide an emergency escape inflatable stowage and deployment device that can be packed and charged prior to installation on a ship or platform.

It is a further object of this invention to provide an emergency escape inflatable stowage and deployment device having a variable stowage volume.

It is a further object of this invention to provide an emergency escape inflatable stowage and deployment device having a fire and/or heat shield.

It is a further object of this invention to provide an emergency escape inflatable stowage device that is essentially unaffected by environmental conditions such as rain, direct heat, etc., and that protects the equipment from such conditions.

It is a further object of this invention to provide an emergency escape inflatable stowage and deployment device of slides or slide/rafts which may be used depending upon the particular application. In some slide or slide/raft deployment devices, the volume of the container is not adjustable to an emergency escape inflatable stowage device that is essentially unaffected by environmental conditions such as rain, direct heat, etc., and that protects the equipment from such conditions.

It is a further object of this invention to provide an emergency escape inflatable stowage and deployment device having means of access to the equipment for inspection or repair without deployment or discharging.

It is a further object of this invention to provide an inflatable emergency slide or slide/raft stowage and deployment device having means to assist passengers in boarding the slide or slide/raft.

These and other objectives which will become evident in the following description are achieved by a closed container mountable on the edge of a deck of a ship or platform having a pivotable panel which is adapted to substantially close the front and top of the container. The panel comprises a pivotable, vertical front section hinged to the container near the edge of the deck and a pivotable, generally horizontal top section hinged to the top of the front section. The top section may be pivoted relative to the front section, thereby opening the container, without a full deployment for inspection or servicing. Upon total pivotal movement, the panel forms a heat shield between the ship or platform and the deployed inflatable emergency equipment. An inclined or sloping sheet is provided within the container for adjusting the stowage volume and to also assist in deployment of the inflatable equipment. A separate inflation system component is designed to be charged prior to installation and latched to the floor of the container to form a neat and compact package. The sloping sheet has a removable middle section which upon removal creates an aisle through the emptied container leading directly to the deployed slide or slide/raft.

BRIEF DESCRIPTION OF THE DRAWINGS

In the drawings:

FIG. 1 is an inflatable evacuation slide stowage and deployment device and inflation system in accordance with the present invention mounted on the deck of a ship;

FIG. 5 is a back view of the stowage and deployment device and inflation system of FIG. 2.

DESCRIPTION OF A PRESENTLY PREFERRED EMBODIMENT

Figures 2, 3:
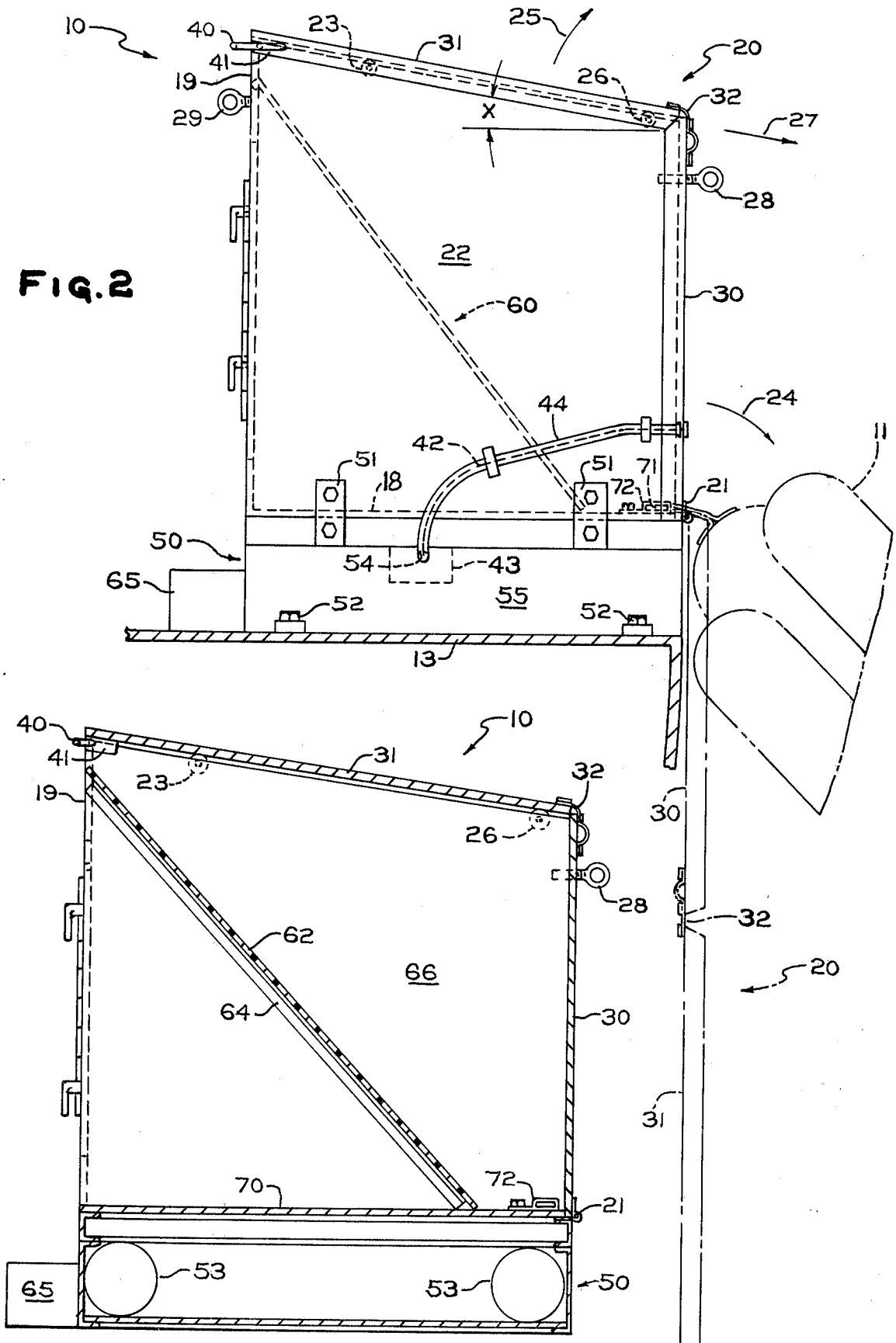
FIG. 2 is an end view of the stowage and deployment device and inflation system according to a preferred embodiment of the present invention shown in a closed position. The device is shown in an opened position in phantom.
FIG. 3 is a sectional end view of the stowage and deployment device and the inflation system shown in FIG. 2.

Referring to FIG. 1, a stowage and deployment device 10 adapted to stow and deploy an inflatable emergency evacuation slide or slide/raft 11 from a ship 12 is shown mounted along the edge of the deck 13 of the ship. Some ships, usually of the passenger carrying type, are designed with glass-sealed portholes 14 directly below the edge of the deck. Attached to the slide 11 are guy wires 15 which are also attached to the ship at points on either side of the device 10. These wires 15 assist in steadying a deployed slide during turbulent weather. The ship has a railing 16 around the edge of the deck, part of which is omitted for mounting of the device 10 and deployment of the slide 11 from the deck.

As is more clearly seen in FIG. 2, the deployment device 10 is a rigid container having a floor 18, two back walls 19 (also see FIG. 5), and two sides 22. A panel 20 has a front section 30 pivotally attached to the front edge of the floor 18 by a front hinge 21. The front section 30 is generally vertically oriented when the container 10 is closed. Upon a release of the panel 20, the front section 30 is free to pivot about the front hinge 21 approximately 180° in an outward direction 24. After the 180° pivotal movement, the front section 30 will be hanging vertically downward over the edge of the ship 12, as is shown in phantom.

The panel 20 also has a top section 31 pivotably attached to the top of the front section 30 by a top hinge 32. The top section 32 is preferably inclined at an angle X of about 15° relative to the deck 13 prior to release of the panel 20. Upon release of the panel 20, gravity assists the top section 31 in sliding along the top of the sides 22 of the container 10 in a downward and outward direction 27 thereby causing the front section 30 to pivot from its vertical position. Upper and lower glides 23 and 26 further assist the top section 31 in this sliding movement. After some sliding has occurred on the glides 23, the pivoting front section 30 will cause the top section 31 to pivot in an outward direction 25 about the top hinge 32 as it is being pulled by the weight of the front section 30 over the lower guides 26.

As seen in FIG. 5, a rod 40 extending through brackets 41 rigidly attached to the top section 31 retains the top section 31 in position. The front section 30 is thereby retained in position due to its attachment to the top section. As seen in FIG. 2, a lanyard 42 is attached to the front section 30. The lanyard 42 is threaded through a lanyard conduit 44 and is connected to an inflation system trigger device 43 in an inflation system 50. The inflation system trigger device can activate an inflation system 50 which is adapted to inflate the slide 11.

In the preferred embodiment of FIG. 2, the inflation system 50 containing tanks 53, the trigger device 43, etc., is a separate component which is affixed to the container 10 by four latches 51. The inflation system 50 is secured to the deck 13 by four bolts 52. The separate component inflation system 50 allows easy access to the system 50 for recharging, repair, inspection, etc. and simplifies the charging and installation procedures.

Alternatively, however, the inflation system 50 could be an integral part of the container 10. This could be accomplished by enlarging the size of the container 10 and by fitting the inflation system tanks 53, trigger 43, etc., within the container Also in a preferred embodiment, a sheet 60 is oriented diagonally within the container 10 and provides a gravity assist for ejection of the slide 11 after the panel 20 is released. The sloping sheet 60 is anchored to the container 10 near the top of the back wall 19 and near the front edge of the floor 18 thereby creating stowage volume 66 within the container 10 in which the slide 11 is to be stowed. Slope sheets, such as 60, of different sizes can be used to vary the size of the stowage volume 66 depending upon the size of slide, such as 11, required.

Figure 4:
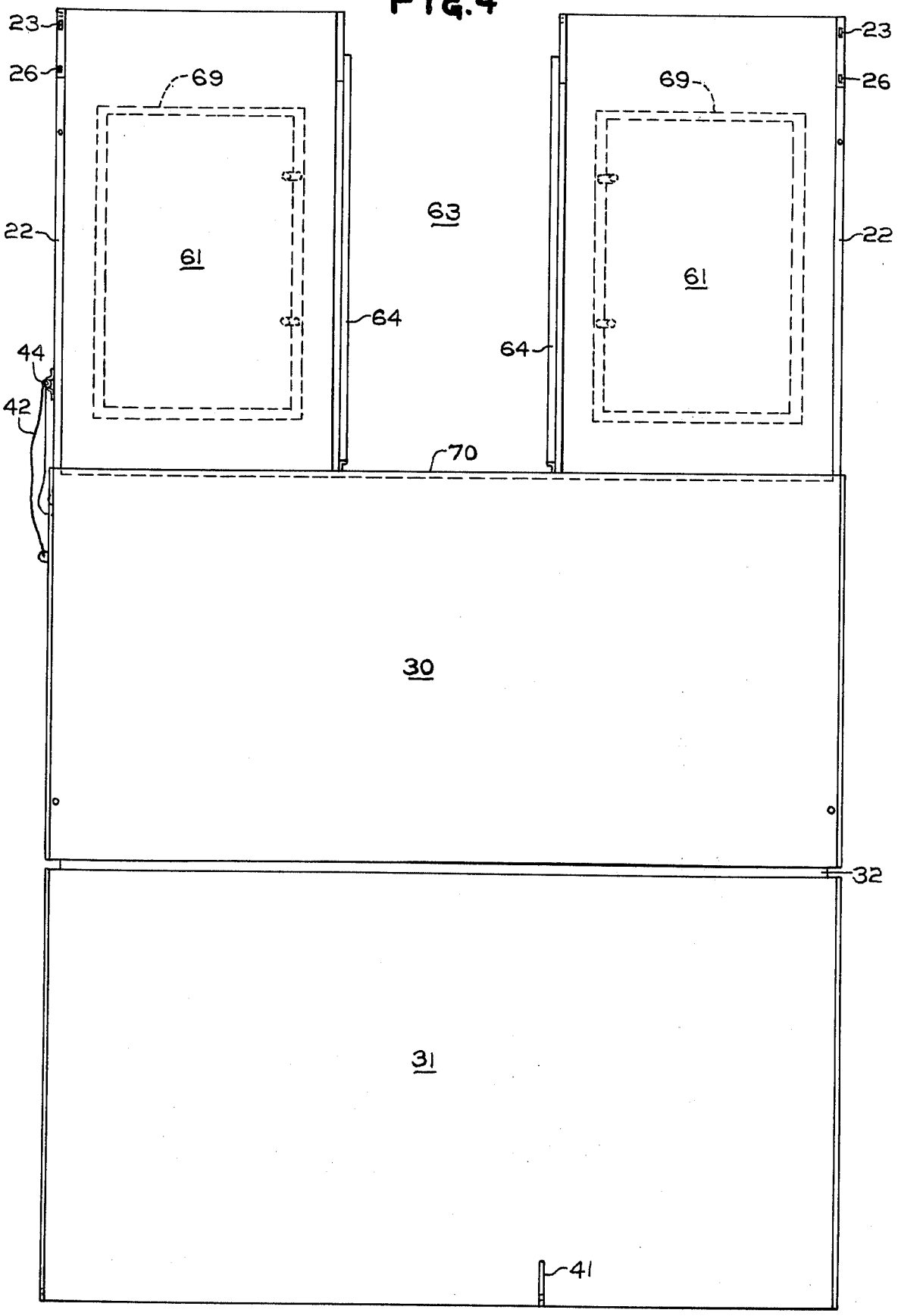
FIG. 4 is a front view of the storage and deployment device of FIG. 2 shown in an opened position.

To facilitate an evacuee's access to a deployed slide, the back walls 19 have a gap 17 between them as can be seen in FIG. 5. The sloping sheet 60 is divided into two end sections 61 (see FIG. 4) and a removable center section 62. Removal of the center section 62 creates an aisle 63 (see FIG. 4) through the container 10 leading to the deployed slide 11. If the container 10 is mounted on top of an inflation system 50, a step 65 may be provided to assist passengers in accessing the aisle 63 on their way to the slide 11. Each of the back walls 19 is of about the same width as each end section 61 of the sloping sheet. The back walls 19 can be rigidly attached to form two rear compartments 68 for storage of life jackets or other safety equipment. The back wall sections 19 can contain doors 69 for this purpose. The floor 18 may have a nonslip material such as a rubber material between the slope sheet end sections 61 and the back wall sections 19 to form a suitable walkway 70.

It is preferred that the container 10 be formed of aluminum sheet metal. This provides a light, fireproof and compact container. It is also preferred that the panel 20 be composed of some light, fireproof and heat resistant material. Presently, a plywood core sandwiched between two sheets of aluminum is preferred.

In operation, the tanks 53 of the inflation system 50 can be charged and the trigger device 43 can be set prior to mounting on the ship 12. The lanyard 42 can be extended out of opening 54 ready for attachment to the container 10. The stowage and deployment container 10 can also be prepared for immediate use prior to mounting.

The slide 11, in a deflated condition, is folded into a small bundle and is placed, ready for deployment, on the sloping sheet 60 in the slide volume 66. The sloping sheet 60 is chosen according to the deflated size of the particular slide 11 being used. The size of the slide 11 depends upon the size of the ship, its height above water level, the number of passengers it will carry, etc. The volume 66 partially enclosed by the panel 20 and the sloping sheet 60 will be large enough to easily accept the folded slide 11. The removable sloping sheet panel 62 placed on top of braces 64 which are secured to inside edges of the ends sections 61 such that all three sloping sheet portions lie in the same plane. The upper end of the slide 11 is secured to a bar 71 which is rigidly attached to the floor 18 of the container 10. The slide 11 is then placed in the area 66 in such a manner as to be easily deployed or rolled out upon release of the panel 20.

In closing the container 10 with the panel 20 the top section 31 is positioned on top of the glides 23. The front section 30 is locked into place by the front eye bolts 28. These front eyebolts 28, together with back eyebolts 29, provide means for lifting and positioning the container 10 on the ship. The top section 31 is locked into place by the rod 40. In this configuration, the top section 31 may be released and opened by means of the rod 40 without releasing the front section 31. Thus, inspection or replacement of parts, even after mounting on the ship and adaption to the inflation system 50, may be accomplished without disengaging the entire system. When the ship is not being serviced, etc., the front eye bolts 28 will be removed and the device 10 will be ready for use.

After packing with an appropriate slide 11 and positioning the panel 20, the container 10 is ready to be installed on a ship 12. To install the inflation system 50 on the ship 12, a section of the rail 16 is removed and the inflation system is placed flush with the edge of the deck 13. The system 50 is secured to the deck 13 by the bolts 52 located near each corner of the system 50. The deployment device 10 is then placed on top of the inflation system 50, and is secured to the inflation system by the latches 51 located near each of the four corners of the inflation system. The lanyard 42 is then fed through the conduit 44 and is attached on the front section 30 of the panel 20. Inspection of the inflation system 50 is made possible by removal of an end panel 55. Maintenance may be accomplished by detaching the lanyard 42 and any hoses, releasing latches 51, and removing the device 10.

In an emergency, the rod 40 can release the top section 31 which, due to gravity, slides downward on glides 23 and 26, thus forcing the front section 30 to rotate. After the top section 31 has moved a distance equal to about half its length, the weight of the front section 30 will rotate the top section 31 off of the upper glides 33 and will pull the top section 31 completely off of the container 10. When the section 30 has rotated slightly, the lanyard 42 will be pulled, thus pulling the trigger device 43 and activating the inflation system 50. The inflation tanks 53 will begin emptying into the slide 11. This immediate inflation will cause the slide 11 to expand, completely filling the volume 66. If both sections 30 and 31 of panel 20 have not completed their downward rotation, the expanding slide 11 will force them in this direction. The panel 20 will drop down and form an apron covering the portholes 14 of the ship, thus protecting the slide 11 from any protrusions that may puncture it on its underside, and from any fire or heat exposed. The slide 11 ultimately becomes fully inflated providing an escape route to a raft (not shown) which can be attached to the lower end of the slide 11. The removable slope sheet panel 62 is then removed, thus providing the aisle 63 through the deployment device 10 leading to the slide 11. The aisle 63 provides a pathway for guidance of alignment for escaping passengers. The container 10 provides an additional safety feature because it forms a type of railing leading to the slide 11. The device 10 also somewhat prevents passengers from looking over the sides of the ship, thus eliminating some panic or psychological stress at a time when calmness is required.

Because most actual slide deployments are for the purpose of testing or training, it is highly desirable to provide an easy method of repacking by the mere release of the latches 51. The inflation system 50 may be released by removing the bolts 52. Thus, the slide packing and recharging may be accomplished separately and conveniently at locations away from the ship.

Although the foregoing structure has been described for the purpose of illustrating a presently preferred embodiment of the invention, it should be understood that many modifications or alterations may be made without departing from the spirit and the scope of the invention as set forth in the appended claims.

I claim:

1. An inflatable emergency escape equipment stowage and deployment device comprising:

a. a container having a floor and a back wall;

b. a pivotable panel substantially closing said container, said panel comprising:

1. a front section;
2. a top section;
3. a front hinge pivotally connecting said front section to said floor; and
4. a top hinge pivotally connecting said top section to said front section; and c. means operable to deploy an emergency evacuation inflatable from said container, said means including an inflation system secured to a deck, an edge of said inflation system being substantially flush with an edge of said deck and wherein said container is removably secured on top, over and flush with said inflation system.

2. The device as defined in claim 1 wherein said means to deploy said inflatable further comprises means for triggering said inflation system automatically upon pivotal movement of said front section.

3. An inflatable emergency escape equipment stowage and deployment device comprising:

a. a container having a floor and a back wall;

b. a pivotable panel substantially closing said container, said panel comprising:

1. a front section;
2. a top section;
3. a front hinge pivotally connecting said front section to said floor; and
4. a top hinge pivotally connecting said top section to said front section; and c. means operable to deploy an emergency evacuation inflatable from said container, said means including a sloping sheet anchored to said back wall adjacent said top section and anchored to said floor adjacent said front section.

4. The device as defined in claim 3 wherein said sloping sheet comprises a removable panel.

* * * * *